United States Patent [19]

Wallhead

[11] Patent Number: 4,848,046

[45] Date of Patent: Jul. 18, 1989

[54] BUILDINGS FOR HARSH ENVIRONMENTS

[76] Inventor: Malcolm Wallhead, Lot 12, Watsons Road, Kettering, Tasmania, Australia, 7155

[21] Appl. No.: 136,557

[22] Filed: Dec. 22, 1987

Related U.S. Application Data

[63] Continuation of Ser. No. 914,645, Oct. 2, 1986, abandoned.

[30] Foreign Application Priority Data

Oct. 11, 1985 [AU] Australia ..... PH2884

[51] Int. Cl.[4] ..... E04B 1/32; E04H 9/16

[52] U.S. Cl. ..... 52/80; 52/82; 52/84

[58] Field of Search ..... 52/80, 81, 82, 84, DIG. 10

[56] References Cited

U.S. PATENT DOCUMENTS

| | | | |
|---|---|---|---|
| 2,705,349 | 4/1955 | Shaw | 52/81 |
| 2,736,072 | 2/1956 | Woods | 52/81 |
| 2,982,290 | 5/1961 | Hunziker | 52/81 |
| 2,986,242 | 5/1961 | Clevett, Jr. | 52/80 |
| 3,002,590 | 10/1961 | Hannoosh et al. | 52/81 |
| 3,043,054 | 7/1962 | Schmidt | 52/81 |
| 3,049,201 | 8/1962 | King et al. | 52/81 |
| 3,186,523 | 6/1965 | Brisse | 52/80 |
| 3,255,556 | 6/1966 | D'Amato et al. | 52/81 |
| 3,284,969 | 11/1966 | Walters et al. | 52/80 |
| 3,388,512 | 6/1968 | Newman | 52/80 |
| 3,473,272 | 10/1969 | Hasselquist | 52/80 |
| 3,618,273 | 11/1971 | Crandall | 52/80 |
| 3,763,608 | 10/1973 | Chamlee | 52/80 |
| 3,921,555 | 11/1975 | Suzuki et al. | 52/80 |
| 3,968,190 | 7/1976 | Stewart | 52/80 |
| 3,994,108 | 11/1976 | Johnson | 52/80 |
| 4,023,317 | 5/1977 | Bettger et al. | 52/80 |
| 4,067,153 | 1/1978 | Davis | 52/80 |
| 4,068,421 | 1/1978 | Marovich | 52/80 |
| 4,230,255 | 10/1980 | Coulter | 52/80 |
| 4,296,869 | 10/1981 | Jawad | 52/80 |
| 4,365,368 | 12/1982 | Boggs | 52/80 |
| 4,550,533 | 11/1985 | Fraioli | 52/80 |
| 4,655,013 | 4/1987 | Ritland | 52/80 |

FOREIGN PATENT DOCUMENTS

| | | | |
|---|---|---|---|
| 587690 | 11/1959 | Canada | 52/81 |
| 2422867 | 11/1975 | Fed. Rep. of Germany | 52/82 |

OTHER PUBLICATIONS

R.C.A. Technical Notes: No. 431, Jan. 1961 (Sheets 1&2).

*Primary Examiner*—Michael Safavi

*Attorney, Agent, or Firm*—Merchant, Gould, Smith, Edell, Welter & Schmidt

[57] ABSTRACT

A building for use in harsh environments where drift materials, such as snow, tend to collect against exterior walls. One or more exterior walls formed of wall panels extend upwardly from a base perimeter of the building, and provide a building exterior surface. The surface curves outwardly and upwardly adjacent the base perimeter so that the exterior walls have an undercut region adjacent that base perimeter. The building is portable, and can be dismantled when not being used.

21 Claims, 2 Drawing Sheets

BUILDINGS FOR HARSH ENVIRONMENTS

This is a continuation of application Ser. No. 914,456, filed 10/2/86, now abandoned.

This invention relates generally to land buildings for harsh environments, and in particular to such buildings for environmental conditions where drift materials tend to build up or collect about stationary objects. The invention is applicable as a portable building used in snow fields, including the arctic and antarctic regions, for accommodation and work shelter and it will be convenient to hereinafter disclose the invention in relation to that exemplary application. It is to be appreciated, however, that the invention is not limited to that application.

Erection of stationary objects, such as buildings, in snow fields generally results in drifting snow collection about the object particularly in the object lee. With buildings, snow can collect against the building walls up to the building roof, where a level is reached at which snow is then sheared away from the building. Large snow build ups often obstruct access to and from the building, and may cause building damage or collapse.

Buildings have been variously shaped and configured in an effort to reduce this snow collection and, to some extent, that is achieved with buildings having an overall rounded or domed shape. However, snow collection remains a serious problem, particularly in environmental conditions such as those occurring in the artic and antarctic regions.

It is an object of the present invention to provide a relatively simple building that will alleviate this snow build up or collection problem. It is a further object to provide a building kit that can be readily assembled into the building, and dismantled when not required for use.

With that object in mind, the present invention provides in one broad aspect a building for use in harsh environments, including: one or more exterior walls extending upwardly from a base perimeter of the building, the exterior wall(s) providing an exterior surface of the building that extends outwardly and upwardly from at least adjacent the base perimeter, whereby the exterior wall(s) have an undercut region adjacent the base perimeter.

This invention is described herein with reference to the building in a normal use orientation on a horizontally extending support surface, and terms such as "upwardly" should be construed in the light of this orientation. However, it is to be appreciated that other orientations may be equally possible and that consequential changes in terms such as that above may be required in the light of those other orientations.

The exterior surface preferably curves outwardly and upwardly in the undercut region. The curvature of that surface is preferably determined by reference to the overall shape and size of the building. In particular, the upward and outward extent of that curvature will preferably be related to the width and/or height of the building.

The exterior surface preferably curves at least substantially throughout the upward extent of the exterior wall(s) from the base perimeter. Whilst that curvature is outward and upward in the undercut region, the surface will preferably thereafter curve inwardly and upwardly. Thus, preferably the exterior surface will have a bulged shape over its upward extent.

The exterior wall(s) preferably extend upwardly toward a top of the building and inwardly toward one another. In that regard, preferably the wall(s) terminate adjacent one another so as to provide at least substantially the entire external surface of the building.

The building base perimeter is preferably curved along at least a partial extent thereof.

Preferably, the building is portable in the sense that it can be transported between use and storage sites. That transportation can preferably be achieved with the building erected ready for use. However, additionally the building can preferably be selectively disassembled for transportation and storage, and assembled and reassembled as desired for use. To that end, at least some of the building wall(s) are preferably constructed of wall panels arranged to be interconnected for assembly of the building and disconnected for dismantling that building. Thus, in another aspect of the present invention, there is provided a building kit of the above building.

The following description refers to preferred embodiments of the building of the present invention. To facilitate an understanding of the invention, reference is made in the description to the accompanying drawings where the building is illustrated. It is to be understood that the invention is not limited to the embodiments as hereinafter described and as illustrated.

Figure 1:
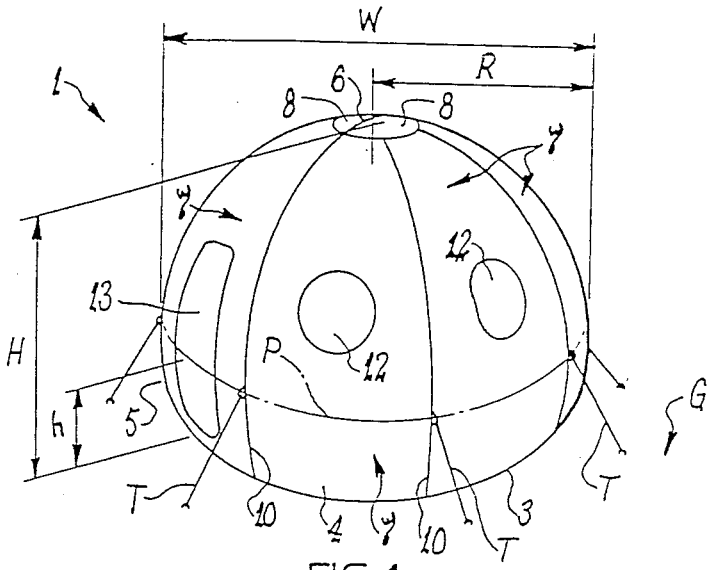
FIG. 1 is a perspective view of the building according to one preferred embodiment of the present invention.
Figure 2:
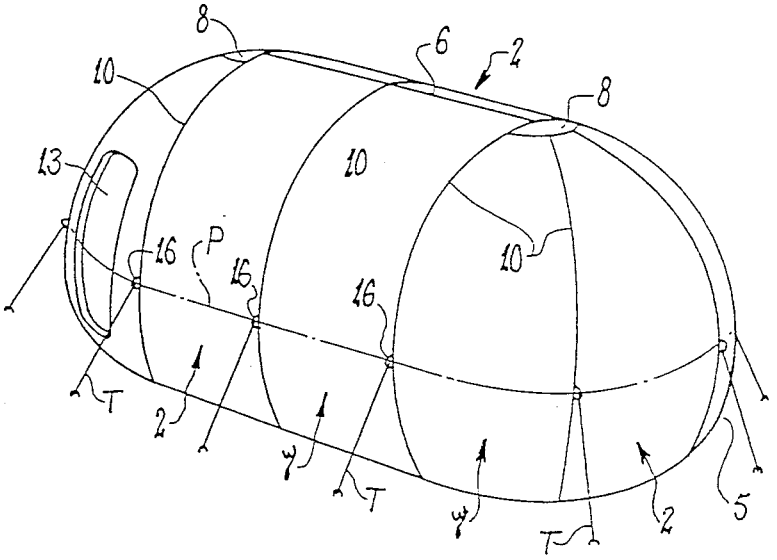
FIG. 2 is a perspective view of the building according to another preferred embodiment of the present invention.
Figure 3:
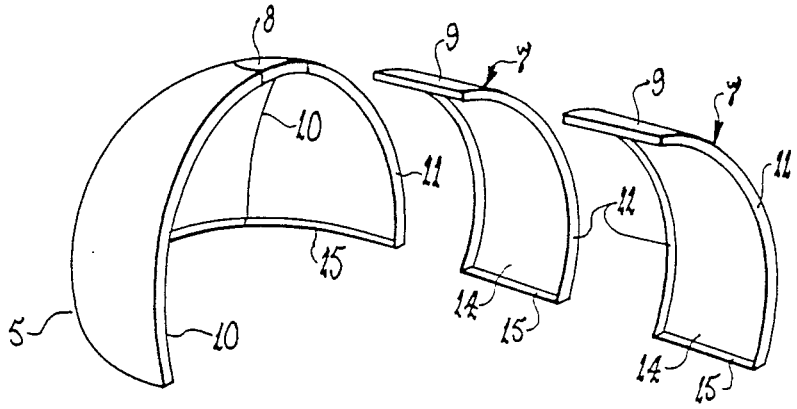
FIG. 3 is an exploded perspective view of part of the building of FIG. 2.

Referring initially to FIGS. 1 to 3, there is illustrated two different, but nevertheless generally similar buildings 1, erected on ground G. Building 1, has one (as illustrated in FIG. 1) or more (as illustrated in FIGS. 2 or 3) exterior building walls 2, extending upwardly from base perimeter 3, and providing exterior surface 4, exposed to the surrounding environment.

Exterior surface 4, curves upwardly from base perimeter 3, in such a manner that surface 4, is slightly bulged. Median horizontal plane P, passes through building 1, at its widest extent with surface 4, extending outwardly and upwardly from base perimeter 3, to plane P, so as to form undercut region 5, in walls 2. Above median plane P, surface 4, extends generally inwardly and upwardly.

Wall(s) 2, provide exterior surface 4, with a curvature related to the overall width of building 1, at least in undercut region 5. Specificallty, the curvature has radius R, which is equal to about half width W, of building 1, at plane P. Upward extent h, of building 1, in undercut region 5, is a small proportion of width W, and/or height H, of building 1. In that regard, upward extent h, will generally be about one fifth building width W. However, as an alternative, extent h, may be about two sevenths of total building height H, where a greater upward extend h, is provided. Again, building width W, will be at plane P, whilst building height H, will be the maximum vertical distance from perimeter 3.

Exterior surface 4, may conveniently have the same radius of curvature R, throughout its upward extent, i.e., the same radius R, as in undercut region 5. However, curvatures of different radii are evisaged.

As illustrated, exterior surface 4, may curve upwardly and converge toward one another at building top 6, so that wall(s) 2, generally provide both the side and top or roof of building 1. Thus, there need be no separate side and top walls in building 1. Alternatively, (not illustrated) exterior surface 4, may meet an exterior surface of one or more separate top walls connected to wall(s), which become side walls. Where that occurs, then exterior surface 4, of wall(s) 2, will generally merge smoothly with the top wall exterior surface. However, the upward curvature of exterior surface 4, may or may not continue through the top wall exterior surface so that, for example, the top wall exterior surface may be differently curved or may be generally planar.

Building 1, may have any suitable plan shape. In that regard, building 1, may have a single wall 2, and so be generally circular in plan shape, as illustrated in FIG. 1. Alternatively, building 1, may have multiple walls 2, with those walls 2, being straight and/or curved in plan and so be generally oblong (as illustrated in FIGS. 2 and 3), oval, or square-shaped (for example).

Building wall(s) 2, are constructed of wall panels 7, each arranged side-by-side one another along base perimeter 3. Where base perimeter 3, is curved then wall panels 7, will be generally segmental shaped (as illustrated) so as to fit one next to another. Any top wall(s) (not illustrated) or cap pieces 8, may be provided as necessary to "fill in" between panels 7, at top 6.

Each panel 7, has outer shell 9, with spaced side edge portions 10. Opposing side edge portions 10, of adjacent panels 7, are in juxtaposition, with adjacent wall panels 7, being interconnected at juxtaposed edge portions 9, to achieve building assembly. That may be achieved by providing each edge portion 9, with connecting flange 11, juxtaposed flanges 11, in turn being fastened together with suitable fastening elements (not illustrated) for example, bolts extending through aligned apertures in flanges 11. Flanges 11, may extend inwardly (as illustrated) or outwardly (not illustrated) relative to exterior surface 4. As will be well appreciated by those skilled in the art, shells 9, will be interconnected so as to form weatherproof seals between panels 7.

Wall(s) 2, and any top wall(s) may be composed of any suitable material. In that regard, wall(s) 2, and in particular panel shells 9, may be molded from plastics material such as plastic resin reinforced with fibreglass. Building features may be incorporated into panel shells 9, during and/or following molding. Exterior surfaces 4, (and also the interior surface of panels 7) may be treated as desired so that, for example, the interior surface may be provided with a decorative and/or heat insulating coating.

Although not illustrated, building 1, may also include a base wall providing base perimeter 3, from which wall(s) 2, upstand, and that base wall may form a floor of building 1. That base wall may be constructed of one or more wall sections or panels to facilitate building assembly and disassembly as outlined above. In any event, that base wall may be interconnected to wall(s) 2, for building assembly and disconnected therefrom for building disassembly. That connection may be achieved by providing end edge portions 14, wall panels 7, with connecting flanges 15, abutting the base wall at base perimeter 3, flanges 15, and the base wall being fastened together through suitable fastening elements (not illustrated) for example, bolts extending through aligned apertures therein.

To facilitate stability of building 1, when in use in harsh environments, the building will generally be "tied down" to surrounding support ground G. To that end, building 1, includes a plurality of connection elements 16, to which tie lines T, can be attached. Those tie lines T, will in turn be secured to ground G, and drawn taut so as to firmly hold building 1, against ground G. Connection elements 16, may be spaced apart about exterior surface 4, at plane P. Connection elements 16, may be connection lugs projecting outwardly from exterior surface 4.

Connection elements 16, may also facilitate transportation of building 1. In that regard, connection elements 16, may be used to secure building 1, to a transporter, whether aircraft, landcraft, or watercraft.

In the example application of building 1, of the present invention, snow blown about building 1, tends to be dispersed away rather than collect about base perimeter 3. That occurs, at least to some extent, by the action of wind about building undercut region 5, scouring now from adjacent base perimeter 3, and carrying it away from building 1. As such, access to and from building 1, can be retained, and building damage or collapse avoided, during these environmental conditions.

Figure 4:
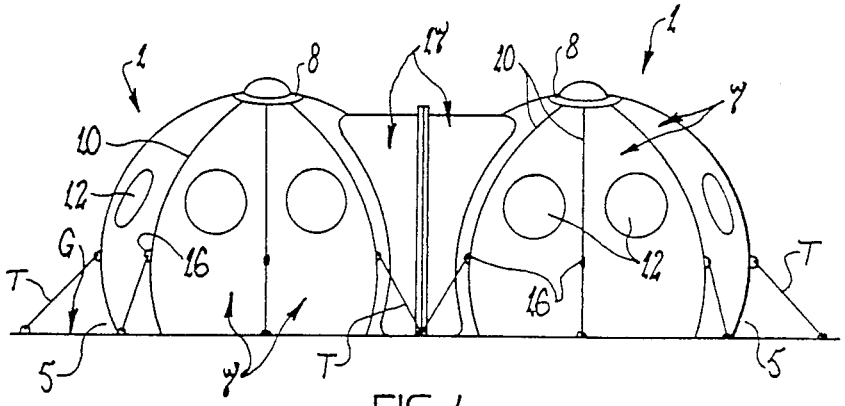
FIG. 4 is a side elevation of a pair of the buildings of FIG. 1 interconnected so as to provide a building complex.

Referring now to FIG. 4 there is shown a modification of building 1, of FIG. 1 whereby two buildings 1, are arranged close to one another and interconnected through corridor panels 17, providing an internal corridor interconnecting the interior of buildings 1, and thereby forming a building complete. Corridor panels 17, may interconnect oppositely facing doorways or other openings provided in individual wall panels 7. Panels 17, may be removably connected to or formed integral with those respective panels 7. Any number of panels 17, may be used to provide the corridor, and those panels 17, may be constructed and interconnected together in a similar manner to panels 7. It should be well appreciated that additional buildings 1, may be added to the complex, and interconnected in any desired arrangement by suitably shaped corridor panels 17, or other connecting facilities.

The building of the present invention may be of a simple and rugged construction able to withstand physically harsh external conditions, cindlugin environmental conditions. Moreover, the building can be constructed for rapid assembly and disassembly as desired, the building being transportable in either an assembled or disassembled condition. These features make the building particularly suitable for temporary or permanent use in harsh external conditions where building transportation and setting up and ongoing building existence may otherwise be difficult and uncertain.

Where the building is constructed for assembly and disassembly as desired, that can be achieved easily with little expertise or building tools. Disassembly of the building may also facilitate transportation and storage.

Finally, it is to be understood that various modifications and/or alterations may be made without departing from the ambit of the present invention as defined in the claims appended hereto. Having now described my invention what

I claim as new and desire to secure by Letters Patent is:

1. A portable building for use in harsh environments, the building being erected on ground and including: a basewall providing a base perimeter, the base perimeter being curved along at least a partial extent thereof; one or more rigid exterior walls secured to the basewall and extending upwardly from the base perimeter, the exterior wall(s) being constructed of a series of wall panels having spaced apart side edge portions, the wall panels being arranged side-by-side one another along the base perimeter and interconnected at juxtaposed side edge portions, and each wall panel extending upwardly from the base perimeter to a top of the building the exterior wall(s) providing a smooth exterior surface with the juxtaposed side edge portions providing an uninterrupted transition of the exterior surface between the wall panels, the exterior surface curving at least substantially throughout the upward extent of the exterior wall(s) from the base perimeter, the exterior surface curving outwardly and upwardly from the base perimeter so as to provide a curved undercut region between the exterior wall(s) and the ground adjacent the base perimeter and curving inwardly and upwardly above the undercut region so that the exterior surface has a generally bulged shape over the upward extent of the exterior surface, the exterior surface having at least substantially the same radius of curvature throughout the upward extent thereof, and the exterior surface in the undercut region having a radius of curvature equal to about half the horizontal width of the building, the horizontal width of the building being measured at a height above the base perimeter at which the upward extent of the undercut region terminates, and the upward extent of the undercut region above the base perimeter being about one-fifth the building width, and about two-sevenths of the total building height above the base perimeter.

2. A building as claimed in claim 1, wherein the base perimeter is at least substantially circular in plan shape.

3. A building as claimed in claim 1, wherein the wall panels are disconnectable from the basewall and from each other for dismantling the building.

4. A building as claimed in claim 1, wherein each wall panel includes an exterior shell providing the exterior surface, and having the side edge portions interconnecting the wall panels together, each of the shells being lightweight and composed of reinforced plastic material.

5. A portable building for use in harsh environments, the building being erected on ground and including: a basewall providing a base perimeter, the base perimeter being curved along at least a partial extent thereof; one or more rigid exterior walls secured to the basewall and extending upwardly from the base perimeter, the exterior wall(s) being constructed of a series of wall panels having spaced apart side edge portions, the wall panels being arranged side-by-side one another along the base perimeter and interconnected at juxtaposed side edge portions, and each wall panel extending upwardly from the base perimeter to a top of the building, the exterior wall(s) providing a smooth exterior surface with the juxtaposed side edge portions providing an uninterrupted transition of the exterior surface between the wall panels, the exterior surface curving at least substantially throughout the upward extent of the exterior wall(s) from the base perimeter, the exterior surface curving outwardly and upwardly from the base perimeter so as to provide a curved undercut region between the exterior wall(s) and the ground adjacent the base perimeter and curving inwardly and upwardly above the undercut region so that the exterior surface has a generally bulged shape over the upward extent of the exterior surface, the exterior surface having at least substantially the same radius of curvature throughout the upward extent thereof, and the exterior surface in the undercut region having a radius of curvature equal to about half the horizontal width of the building, the horizontal width of the building being measured at a height above the base perimeter at which the upward extent of the undercut region terminates, and the upward extent of the undercut region above the base perimeter being about one-fifth the building width, and about two-sevenths of the total building height above the base perimeter; a plurality of connection elements provided on the exterior surface and spaced apart about the exterior wall(s); and tie lines attached to the connection elements and secured to the ground, the tie lines being taut so as to firmly hold the building against the ground.

6. A building as claimed in claim 5, wherein the connection elements are connection lugs located at a height above the base perimeter at which the upward extent of the undercut region terminates.

7. A building as claimed in claim 5, wherein the base perimeter is at least substantially circular in plan shape.

8. A building as claimed in claim 5, wherein the wall panels are disconnectable from the basewall and from each other for dismantling the building.

9. A building as claimed in claim 5, wherein each wall panel includes an exterior shell providing the exterior surface, and having the side edge portions interconnecting the wall panels together, each of the shells being lightweight and composed of reinforced plastic material.

10. A portable building for use in harsh environments, the building being erected on ground and including: a basewall providing a base perimeter, the base perimeter being curved along at least a partial extent thereof; one or more rigid exterior walls secured to the basewall and extending upwardly from the base perimeter the exterior wall(s) being constructed of a series of wall panels having spaced apart side edge portions, the wall panels being arranged side-by-side one another along the base perimeter and interconnected at juxtaposed side edge portions, and each wall panel extending upwardly from the base perimeter to a top of the building, the exterior wall(s) providing a smooth exterior surface with the juxtaposed side edge portions providing an uninterrupted transition of the exterior surface between the wall panels, the exterior surface curving at least substantially throughout the upward extent of the exterior wall(s) from the base perimeter, the exterior surface curving outwardly and upwardly from the base perimeter so as to provide a curved undercut region between the exterior wall(s) and the ground adjacent the base perimeter and curving inwardly and upwardly above the undercut region so that the exterior surface has a generally bulged shape over the upward extent of the exterior surface, the exterior surface having at least substantially the same radius of curvature throughout the upward extent thereof, and the exterior surface in the undercut region having a radius of curvature equal to about half the horizontal width of the building, the horizontal width of the building being measured at a height above the base perimeter at which the upward extent of the undercut region terminates, and the upward extent of the undercut region above the base perimeter being about one-fifth the building width.

11. A building as claimed in claim 10, and further including a plurality of connection elements provided on the exterior surface and spaced apart about the exterior wall(s), and tie lines attached to the connection elements and secured to the ground, the tie lines being taut so as to firmly hold the building against the ground.

12. A building as claimed in claim 11, wherein the connection elements are connection lugs located at a height above the base perimeter at which the upward extent of the undercut region terminates.

13. A building as claimed in claim 10, wherein the base perimeter is at least substantially circular in plan shape.

14. A building as claimed in claim 10, wherein the wall panels are disconnectable from the basewall and from each other for dismantling the building.

15. A building as claimed in claim 10, wherein each wall panel includes an exterior shell providing the exterior surface, and having the side edge portions interconnecting the wall panels together, each of the shells being lightweight and composed of reinforced plastic material.

16. A portable building for use in harsh environments, the building being erected on ground and including: a basewall providing a base perimeter, the base perimeter being curved along at least a partial extent thereof; one or more rigid exterior walls secured to the basewall and extending upwardly from the base perimeter the exterior wall(s) being constructed of a series of wall panels having spaced apart side edge portions, the wall panels being arranged side-by-side one another long the base perimeter and interconnected at juxtaposed side edge portions, and each wall panel extending upwardly from the base perimeter to a top of the building, the exterior wall(s) providing a smooth exterior surface with the juxtaposed side edge portions providing an uninterrupted transition of the exterior surface between the wall panels, the exterior surface curving at least substantially throughout the upward extent of the exterior wall(s) from the base perimeter, the exterior surface curving outwardly and upwardly from the base perimeter so as to provide a curved undercut region between the exterior wall(s) and the ground adjacent the base perimeter and curving inwardly and upwardly above the undercut region so that the exterior surface has a generally bulged shape over the upward extent of the exterior surface, the exterior surface having at least substantially the same radius of curvature throughout the upward extent thereof, and the exterior surface in the undercut region having a radius of curvature equal to about half the horizontal width of the building, the horizontal width of the building being measured at a height above the base perimeter at which the upward extent of the undercut region terminates, and the upward extent of the undercut region above the base perimeter being about two-sevenths of the total building height above the base perimeter.

17. A building as claimed in claim 16, and further including a plurality of connection elements provided on the exterior surface and spaced apart about the exterior wall(s), and tie lines attached to the connection elements and secured to the ground, the tie lines being taut so as to firmly hold the building against the ground.

18. A building as claimed in claim 17, wherein the connection elements are connection lugs located at a height above the base perimeter at which the upward extent of the undercut region terminates.

19. A building as claimed in claim 16, wherein the base perimeter is at least substantially circular in plan shape.

20. A building as claimed in claim 16, wherein the wall panels are disconnectable from the basewall and from each other for dismantling the building.

21. A building as claimed in claim 16, wherein each wall panel includes an exterior shell providing the exterior surface, and having the side edge portions interconnecting the wall panels together, each of the shells being lightweight and composed of reinforced plastic material.

* * * * *